US006237227B1

(12) United States Patent
Pojunas, Sr.

(10) Patent No.: US 6,237,227 B1
(45) Date of Patent: May 29, 2001

(54) APPARATUS FOR PROVIDING DRAIN PASSAGE 16S IN A METAL CONTAINER OF FLUIDS

(76) Inventor: Leonard William Pojunas, Sr., 1208 Gyros Ct., Bel Air, MD (US) 21014

( * ) Notice: Subject to any disclaimer, the term of this patent is extended or adjusted under 35 U.S.C. 154(b) by 0 days.

(21) Appl. No.: 09/387,433

(22) Filed: Sep. 1, 1999

(51) Int. Cl.[7] ..... B26F 1/32
(52) U.S. Cl. ..... 30/366; 30/445; 83/30
(58) Field of Search ..... 30/366, 445, 443, 30/367, 368, 444; 83/30

(56) References Cited

U.S. PATENT DOCUMENTS 1,080,636 * 12/1913 Johnson ..... 30/445 X

* cited by examiner

*Primary Examiner*—Douglas D. Watts
(74) *Attorney, Agent, or Firm*—Leonard W. Pojunas, Jr.

(57) ABSTRACT

An apparatus provides drain passages in an annular channel in the lip of a metal container for fluids. A metal or plastic support is shaped as an annular ring. Each punch of a plurality of metal punches has a corresponding base and point. The base of each punch is integrally connected to a front face of the support such that each point projects perpendicularly to the front face and in a common direction parallel to an axis of the annular ring. The punches are spaced so that each point can be aligned simultaneously with the annular channel of the metal can. The rear face of the support comprises a surface for driving the punches through the annular channel and creating fluid drain passages in the channel. The support can comprise a spoke-configuration having spokes extending from a hub. The base of each punch is integrally connected to extend from a corresponding spoke.

1 Claim, 2 Drawing Sheets

APPARATUS FOR PROVIDING DRAIN PASSAGE 16S IN A METAL CONTAINER OF FLUIDS

FIELD OF THE INVENTION

The invention relates to a device for punching holes in sheet metal. More specifically, the invention relates to a support having integral punches for piercing the annular channel of a metal container.

BACKGROUND OF THE INVENTION

Varnishes, paints, stains and other fluids often come in metal cans. This well-known type of can is a simple cylinder of metal with an attached circular metal bottom at its closed end. At the open end of each can is an annular lip and an annular channel for receiving a can lid. The lid has an annular ridge that frictionally engages the annular channel to seal the can after the can is filled with fluid.

While using paint from a can, the painter frequently scrapes his or her brush against the annular lip at the top of the can to remove excess paint from the brush. In this way, paint accumulates in the annular channel of the can. Because a painter will often use less than an entire can of paint, to preserve the freshness of the paint (or varnish or stain), the painter would replace the lid on the can. However, the paint that has accumulated in the annular lip would run over the side of the can as the painter replaces the lid. This not only complicates cleanup, but prevents tight closure of the lid on the top of the can. Air seeps into the can and dries or ruins the paint. For these reasons, the painter must first clean the annular lip of excess paint using his or her brush, rags, etc. before replacing the lid on top of the can. This further complicates cleanup, as paint spills over the can sides, and the brush is saturated with paint from the annular lip.

Thus, a need exists for a means to keep the annular lip of a can free from accumulating paint, varnish, stain, or other fluids, to reduce cleanup efforts and maintain paint freshness, which is accomplished by this invention.

SUMMARY OF THE INVENTION

In another embodiment, the apparatus comprises a support having a first face defining a plane and a second face connecting to the first face such that the first face is at least generally parallel to the second face. The apparatus further comprises a plurality of metal punches, each punch having a corresponding base and point. The base of each punch is integrally connected to the first face such that each punch projects perpendicular to the plane in a common direction, wherein each point is simultaneously alignable with the annular channel of a fluid container. The second face further comprises an engageable means for driving the punches through the annular channel and creating fluid drain passages.

DETAILED DESCRIPTION OF THE INVENTION

Figure 1A:
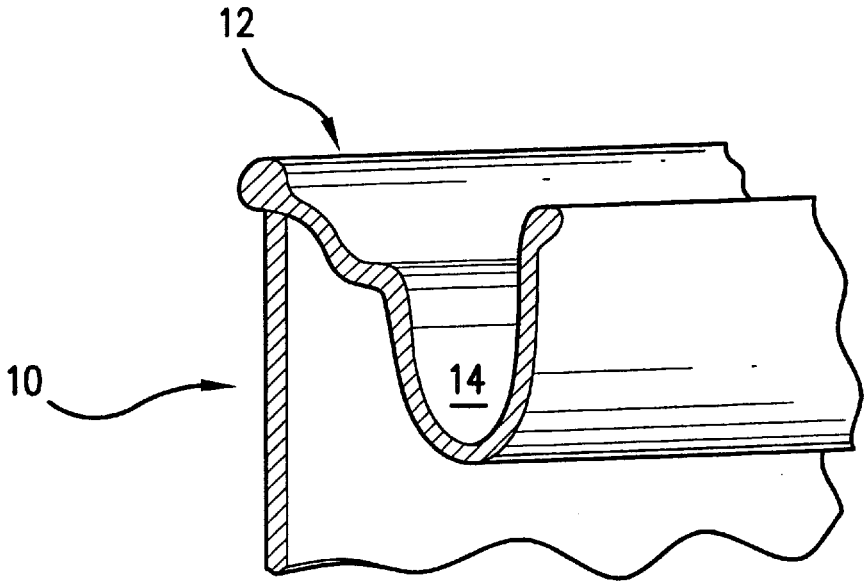
FIG.1A PRIOR ART
FIG. 1A shows a cross-sectional view of a portion of a typical can for holding fluids.

FIG. 1A shows in cross-section a portion of a typical can 10 for holding fluids. This well-known type of can 10 is a simple cylinder of metal with an attached circular metal bottom at its closed end. At the open end of each can 10 is an annular lip 12 having an annular channel 14. The annular lip 12 and annular channel 14 are for receiving a can lid (not shown). The lid has an annular ridge that frictionally engages the annular channel 14 as the lid is pushed onto the can to seal the can 10 after the can has been filled with fluid.

Figure 1B:
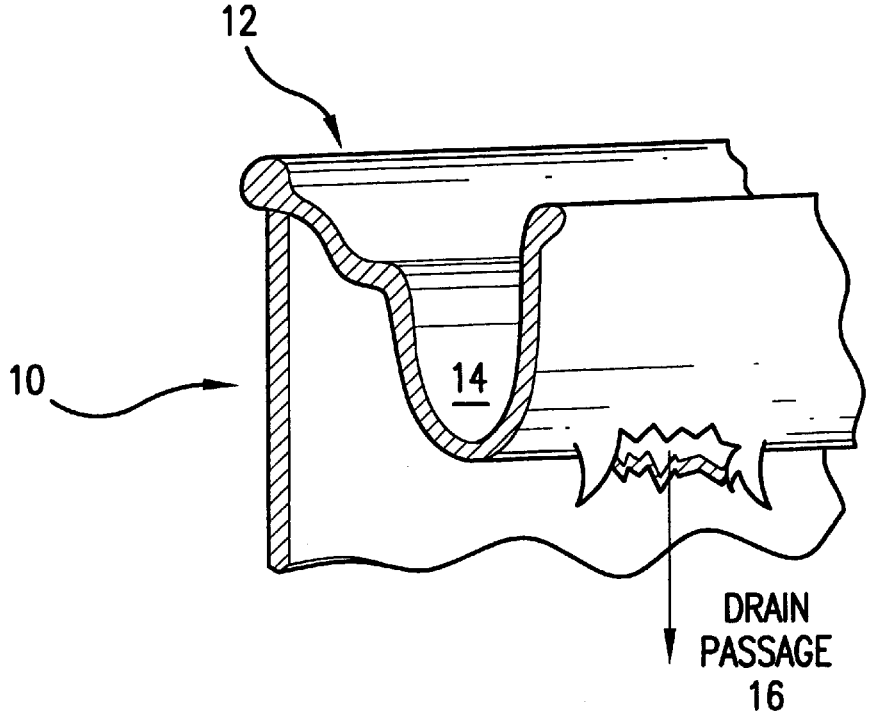
FIG. 1B shows one drain passage provided in an annular channel 14 of the can of FIG. 1A.

FIG. 1B shows in cross-section a drain passage 16 in the annular channel 14 of FIG. 1A for draining fluid, provided by the present invention. The annular channel 14 of the lid includes a number of similar drain passages 16 as provided by the present invention.

As described below concerning FIGS. 2A,2B, 3A and 3B, points 34 of punches 30 are aligned with the annular channel 14. Force is applied to a rear face 28 of a support carrying the punches 30 with a hammer or otherwise. This causes the punches 30 to simultaneously pierce the annular channel 14, providing a number of drain passage 16 in the annular channel 14. Fluid accumulating in the annular channel 14 will flow towards and through the drain passage 16 and back into the can, providing a clean annular channel 14 for easy resealing of the lid onto the can.

Figure 2A:
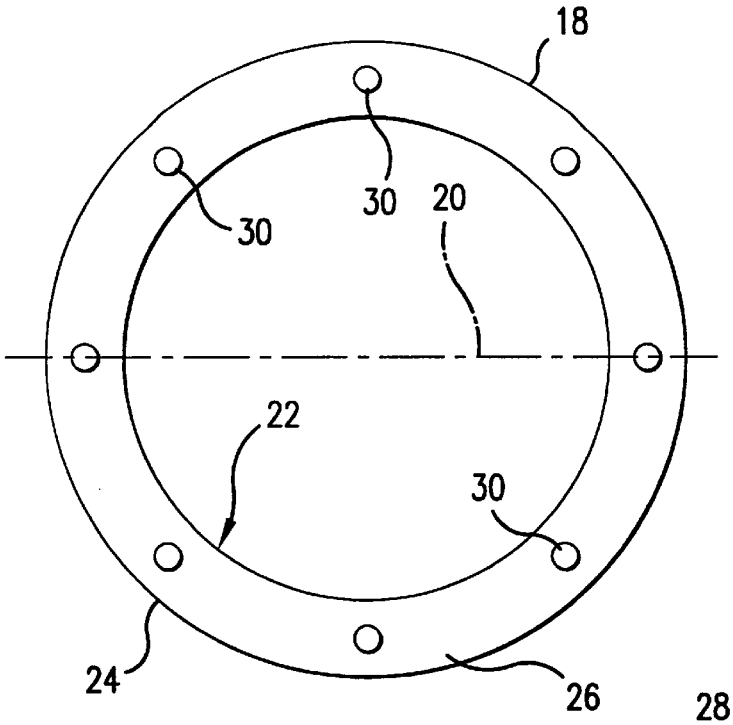
FIGS. 2A and 2B show an embodiment of the invention in a ring-configuration.
Figure 2B:
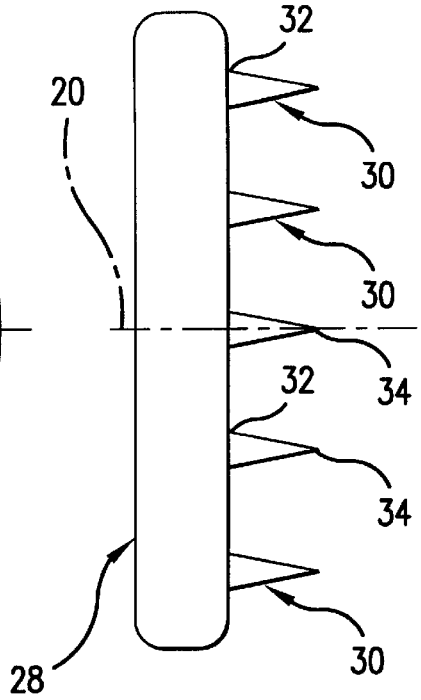
Figure 3A:
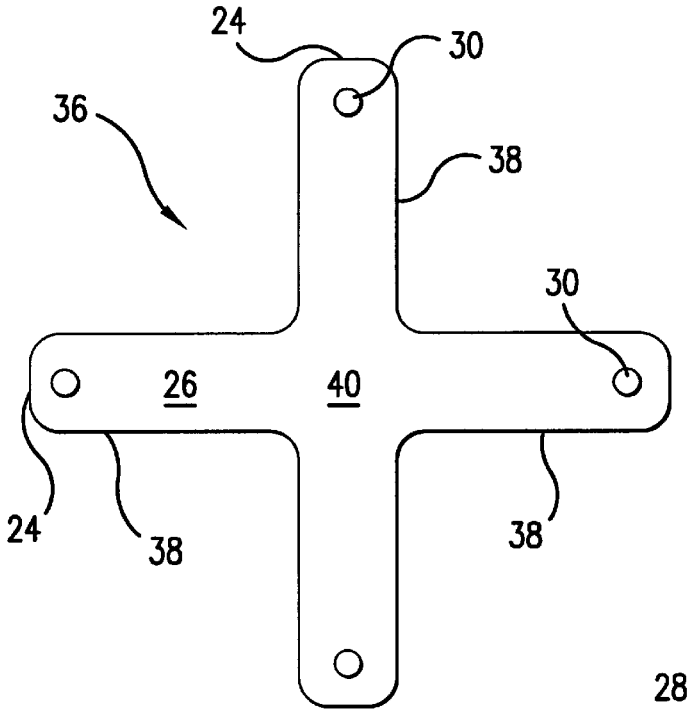
FIGS. 3A and 3B show an embodiment of the invention in a spoked-configuration.
Figure 3B:
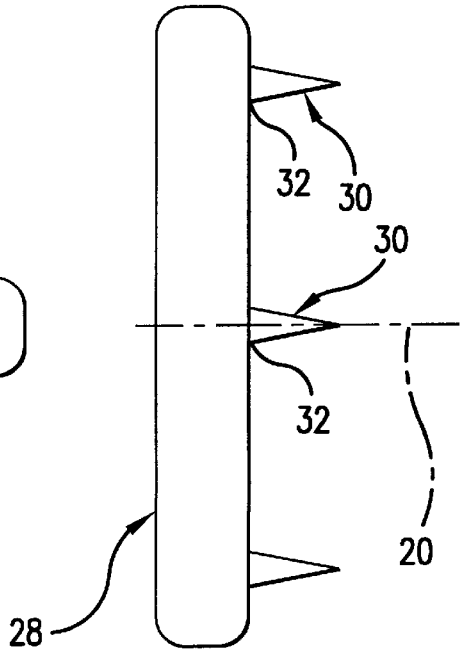

FIG. 2A is a top view and FIG. 2B is a side view of an embodiment of the invention in a circular configuration for providing drain passages 16 in a container for fluids. An annular ring 18 defines a plane and has a central axis 20 perpendicular to the plane. An inner annular surface 22 of the ring 18 is parallel to the axis and has a first diameter. An outer annular surface 24 of the ring 18 is parallel to the axis and has a second diameter greater than the first diameter. A front face 26 connects the inner annular surface 22 to the outer annular surface 24 such that the front face 26 is perpendicular to both the inner annular surface 22 and to the outer annular surface 24. A rear face 28 connects the inner annular surface 22 to the outer annular surface 24 such that the rear face 28 is perpendicular to both the inner annular surface 22 to the outer annular surface 24, and such that the front face 26 is parallel to the rear face 28. Accordingly, a cross-section of the support is rectangular, but other cross-sections are possible. Preferably, the ring 18 is metal or plastic or other hard substance.

The annular ring 18 includes a plurality of punches 30. Each punch 30 has a corresponding base 32 and point 34. The base 32 of each punch 30 is connected to the first, front face 26 such that each punch 30 projects perpendicular to the plane and parallel to the axis of the annular ring 18 in a common direction. Preferably, the punches 30 are integrally connected at their base 32 to a metal ring by welding. The ring and punches 30 could comprise an integral unit. The punches 30 could be screwed or bolted to the support, for example. The punches 30 are mounted to the support in a substantially circular pattern. Preferably, the punches 30 are spaced equidistantly about the ring 18 in a circular pattern.

Each point 34 is positioned radially from the axis 20 of the annular ring 18 between the first diameter and the second diameter. The diameter of the ring 18 and the placement of punches 30 is such that each point 34 can be simultaneously aligned with the annular channel 14 of the metal can 10.

The ring 18 can be of any diameter. Preferably, the diameter of the ring 18 is chosen to correspond to the diameter of a gallon, quart, or pint can, for example, so the points 34 of the punches 30 align with the annular channel 14 of such a can.

The rear face 28 comprises a surface to be forcefully engaged with a hammer, for instance. Hitting the rear face 28 of the support with a hammer drives the punches 30 through the annular channel 14 and creates fluid drain passages 16. If the points 34 are sharp, one might use the palm of the hand to hit the rear face 28 and drive the punches 30 through the annular channel 14.

FIG. 4 shows an embodiment of the invention in a spoke-configuration 36. The support comprises a configuration having spokes 38 extending from a hub 40. The base 32 of each punch 30 is integrally connected to extend from a corresponding spoke 38. There can be any number of spokes.

The support again defines a plane and has a central axis 20 perpendicular to that plane. In this case, a circle can be described around the radial ends of the spokes 38. It is these radial ends of the spokes 38 that comprise an outer surface 24 of the support. This embodiment illustrates four spokes 38, but the support can have any number of spokes.

A front face 26 connects to the outer surface 24 such that the first face is relatively perpendicular to a portion of the outer annular surface 24. The front face 26 may be rounded in one embodiment so that a cross-section of one spoke 38 of the support would be semi-circular. The front face 26 can merge gradually into the outer surface, but an upper portion of the front face 26 is relatively perpendicular to the outer surface. In another embodiment, a second face 28 connects to the outer annular surface 24 such that the second face 28 is perpendicular to the outer annular surface 24, and such that the first face 26 is generally parallel to the second face 28.

Each punch 30 of a plurality has a corresponding base 32 and point 34. The base 32 of each punch 30 is connected to the first face 26 such that each punch 30 projects perpendicular to the plane and parallel to the central axis 20 in a common direction. Each point 34 is positioned from the central axis 20 so that the points 34 can be simultaneously aligned with the annular channel 14 of the metal can 10. The second face is forcefully engaged to drive the punches 30 through the annular channel 14 to create fluid drain passages 16.

Other embodiments are apparent to those skilled in the art, the scope of the invention being defined by the appended claims.

I claim:

1. A method for providing fluid drain passages in an annular channel of a metal can, the metal can being resealable with a removable lid that engages the annular channel of the metal can, the steps comprising:

a. aligning a support with the metal can, the support defining a plane and having:
   - a central axis perpendicular to the plane,
   - a face perpendicular to the central axis and parallel to the plane,
   - a plurality of punches, each punch having a corresponding base and point, wherein the base of each punch is integrally connected to the face such that each punch projects perpendicular to the plane and parallel to the axis of the support in a common direction, b. aligning the plurality of punches of the support with the annular channel of the metal can, c. applying pressure to the support and piercing the annular channel with the plurality of punches, and d. removing pressure from the support to form a plurality of drain passages in the annular channel while retaining the annular channel in the metal can such that the annular channel is still engagable with the removable lid.

* * * * *